United States Patent [19]

Masaki et al.

[11] Patent Number: 5,026,620

[45] Date of Patent: Jun. 25, 1991

[54] METHOD FOR FORMING ELECTROPHOTOGRAPHIC IMAGES

[75] Inventors: Hiroya Masaki; Hiroyuki Takagiwa; Meizo Shirose; Michiaki Ishikawa, all of Hachioji, Japan

[73] Assignee: Konica Corporation, Tokyo, Japan

[21] Appl. No.: 367,855

[22] Filed: Jun. 16, 1989

[30] Foreign Application Priority Data

Jun. 24, 1988 [JP] Japan ..... 63-157720

[51] Int. Cl.[5] ..... G03G 13/20; G03G 13/22

[52] U.S. Cl. ..... 430/99; 430/110; 430/111; 430/126

[58] Field of Search ..... 430/99, 110, 111, 126

[56] References Cited

U.S. PATENT DOCUMENTS 4,288,517 9/1981 Arimatsu et al. ..... 430/99 X
4,640,882 2/1987 Mitsuhashi et al. ..... 430/110
4,680,245 7/1987 Suematsu et al. ..... 430/110
4,734,350 3/1988 Lin et al. ..... 430/110
4,902,598 2/1990 Winnik et al. ..... 430/110

OTHER PUBLICATIONS

Derwent Abstract 80-29808C JPA-55-17944.
Derwent Abstract 89-111597 JO-1059238.

*Primary Examiner*—Roland Martin
*Attorney, Agent, or Firm*—Jordan B. Bierman

[57] ABSTRACT

A method for forming an electrophotographic image, comprising forming an electrostatic latent image on a latent image carrier, developing said latent image with a developer to form a toner image, transferring said toner image on a recording material, and fixing the toner image with a heat roller, is disclosed. The method is characterized by:

1) said developer comprises an inorganic fine particle having pH of not lower than 7.0, and
2) a resin coating layer containing carbon black is provided on said heat roller, and is grounded.

12 Claims, 2 Drawing Sheets

METHOD FOR FORMING ELECTROPHOTOGRAPHIC IMAGES

INDUSTRIAL FIELD OF THE INVENTION

This invention relates to an electrophotographic copying and, more particularly, to a developer for forming a copy image and fixing of the copy image.

BACKGROUND OF THE INVENTION

As the methods for forming images from an information which is to e visualized, the methods for forming images through electrostatic latent images, such as an electrophotographic method, an electrostatic recording method, an electrostatic printing method, and so forth, have been widely utilized.

In the electrophotographic method, for example, a toner image is formed in such a manner that, after a uniform electrostatic charge is applied to a latent image carrier provided thereon with a light-sensitive layer comprising of a photoconductive material, an electrostatic latent image is formed on the surface of the latent image carrier by image-wise exposing the carrier to light so as to Correspond to an original image, and the electrostatic latent image is developed with a developer. The resulted toner image is transferred onto a recording member such as paper and the like, and the transferred image is then fixed by heating, pressing or the like, so that a copy image can be formed. The latent image carrier subjected to an image-transferring step is electrically neutralized, and the toner remaining untransferred on the latent image carrier is cleaned up to be used for the next copy image formation.

In order to form stably a copy image with high quality and free of fog over many times, it is further required that triboelectric charge of toners is kept stable.

There have been well-known examples of the developers applicable to electrophotographic methods including an electrostatic image developer comprising of toner particles containing polyesters as the binder resins, inorganic fine particles comprising negatively chargeable fine particle silica, and fluoro resin-coated carriers, described in Japanese Patent Open to Public Inspection (hereinafter referred to as Japanese Patent O.P.I. Publication) No. 60-176052/1985; another electrostatic image developer comprising of toner particles containing polyesters as the binder resins, positively chargeable inorganic fine particles comprising of alumina, titanium oxide and nitrogen-containing silica, and so forth, and fluoro resin-coated carriers, described in Japanese Patent O.P.I. Publication No. 62-229158/1987: and so forth.

According to the technique using a combination 0f negatively chargeable fine particle silica and fluoro resin carriers having an intensive negative chargeability, which is disclosed in the above-given Japanese Patent O.P.I. Publication No. 60-176052/1985, the toner particles have slow start in triboelectric charging, and due to toner scattering in a developing unit as a copying operation cycle increases, a charging electrode, a transfer electrode, a separation electrode and so forth are stained, so that poor transferring or forming of image is liable to be caused In addition to the above, when toner scattering increases, a back of leading edge of a transfer member is liable to be stained with toner.

In the meantime, fluoro resins which are used as a coating layer for a fixing roller, such as polytetrafuloroethylene, polyfluoroethyleneproylene and so forth, have an excellent electric insulation property and are easily charged to negative.. Based on the above-mentioned fact. Japanese Patent O.P.I. Publication No. 62-229158/1987 discloses a technique using positively chargeable inorganic fine particles, where the toner particles show good start in triboelectric charging and therefore, poor image forming caused by toner scattering may be reduced, but on the contrary, an electrostatic adhesion to a negatively charged fixing roller increases due to high positive charge of toner particles, so that an anti-offset property is worsened and a replacement cycle of a cleaning roller is shortened On the other hand, the techniques for improving an anti-offset property have been disclosed in, for example, Japanese Patent Examined Publication No. 58-23636/1983, in which a low resistive substance is incorporated a coating layer for a heat roller: Japanese Patent O.P.I. Publication Nos. 57-150869/1982, 59-83181/1984 and 59-111177/1984, in which a conductive substance is incorporated into a primer layer: Japanese Patent O.P.I. Publication No. 61-100777/1986, in which oxobenzoyl polyether and carbon black are incorporated into polytetrafluoroethylene used as a coating layer for a heat roller; and so forth.

According to the above-mentioned techniques, lapping of an offset type paper on a heat roller is improved by conductivity of a coating layer for a heat roller On the other hand, there are defects that in the case a low resistive transfer paper is used or where a transfer paper absorbs moisture under a circumstance of high temperature and humidity and a resistance of the transfer paper is lowered, a transfer current leaks from the heat roller, so that poor transferring is caused and a transfer efficiency is lowered

| | |
|---|---|
| 1 | Heat roller, |
| 2 | Pressure roller, |
| 11 | Cylindrical substrate, |
| 12 | Primer layer, |
| 13 | Releasing layer, |
| 14 | Heat source, |
| 21 | Cylindrical substrate, |
| 22 | Elastic layer |

SUMMARY OF THE INVENTION

The object of this invention is to provide a method for forming images, wherein toner can show an excellent start in triboelectric charge: a positive triboelectric charging can be kept stable for a long period: an excellent transferability can also be maintained: electrostatic adhesion of a toner to a fixing roller can be lowered: and a replacement cycle of a cleaning roller can be prolonged: so that a life of a developer and a maintenance cycle of a fixing device can be prolonged.

DETAILED DESCRIPTION OF THE INVENTION

The above-mentioned object of the invention can be achieved with an electrophotographic image forming method comprising of forming an electrostatic latent image on a latent image carrier, developing the latent image with a developer, transferring the resulted toner image onto a recording member, and fixing the transferred image with a heat roller, wherein the method is characterized by that the developer contains inorganic fine grains having a pH value of not lower than 7.0, a resinous coating layer dispersively containing carbon black is provided on a surface of a heat-fixing roller, and the coating layer is grounded.

A volume resistivity of the above-mentioned resinous coating layer is preferably $10^4\Omega$cm–$10^{11}$ $\Omega$cm.

Now, the invention will be detailed.

Figure 1A:
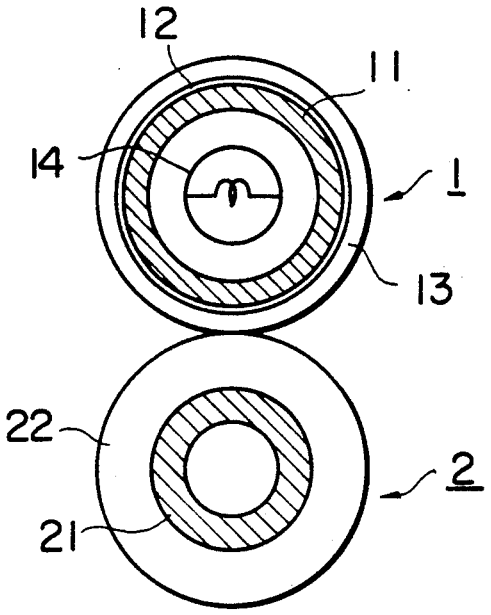
FIG. 1 shows a cross-sectional view of a heat roller of the invention.
Figure 1B:
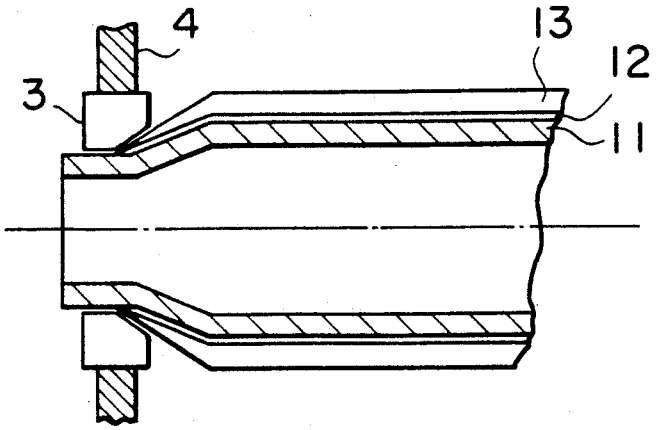

FIG. 1 shows a typical example of a fixing roller relating to the invention. FIG. 1(*a*) is a cross-section perpendicular to the shafts of a heat roller 1 and a pressure roller 2. FIG. 1(*b*) us a partial cross-section including the shaft of the heat roller 1.

Heat roller 1 and pressure roller 2 are mounted to a chassis of a copy machine so as to bring two rollers into contact with each other at a prescribed pressure. Generally,. a rotary drive mechanism is coupled to the heat roller so that the pressure roller rotates freely along with it.

The bearings for mounting these rollers are preferably conductive. Particularly in the invention,. it is essential that bearing 3 for the heat roller 1 is made of a conductive substance so as to be grounded.

Pressure roller 2 is comprised of a cylindrical substrate 21 made of aluminum or the like,. provided thereon with elastic layer 22 comprising an elastic resin such as silicon rubber or the like.

Heat roller 1 is comprised of a cylindrical substrate 11 made of aluminum or the like,. provided thereon with a releasing layer 13 via a primer layer 12 for adhesion In addition,. a heat source such as halogen heater 14 is inserted into a hollow space the cylindrical substrate 11. In FIG. 1(*b*), heat source 14 is not shown.

Thermistor 4 detects a surface temperature of heat roller 1, and the heat source is coupled to a temperature control means to switch it on and off, so that a suitable fixing temperature range can be kept without causing any offset trouble The above-mentioned releasing layer 13 is preferably comprised of a fluoro resin with excellent releasability. It is particularly preferable that the composition of such a resin comprises at least one a tetrafluoroethyleneperfluoroalkyl vinylether copolymer (PFA resin), a fluoroethylene-hexafluoropropylene copolymer (FEP resin). and polytetrafluoroethylene (PTFE resin).

In the invention, a volume resistivity of releasing layer 13 can be adjusted by dispersively adding carbon black to the resin of the releasing layer Such volume resistivity is preferably in a range of $10^4\Omega$cm to $10^{11}\Omega$cm. If a volume resistivity exceeds $10^{11}\Omega$cm, an anti-offset property tends to be deteriorated to an extent where there is caused no practical problem. The volume resistivity less than $10^4\Omega$cm may cause poor transferring in an atmosphere of high temperature and humidity.

In the invention, excessive carbon black is liable to lower a releasability and an antioffset property The above-mentioned carbon black is preferably such as having a so-called high structure level, that is, having primary carbon particles which are linked grapewise and have large specific area, for example, fine powder of colloidal carbon which is made by incomplete combustion or thermal decomposition of hydrocarbon.

The fine powders of colloidal carbon are classified by their raw materials, production methods and characteristics, and include thermal black, furnace black, channel black, acetylene black. Koechen black, and so forth, each having an effect for improving conductivity. Among them, acetylene black and Koechen black are preferable because of larger contribution to conductivity in a less addition amount. The examples of acetylene black available on the market include Denka Black® manufacutured by Denki Kagaku Kogyo Co., and those of Koechen black include Koechen Black EC manufactured by Lion-Akzo Co.

Figure 2:
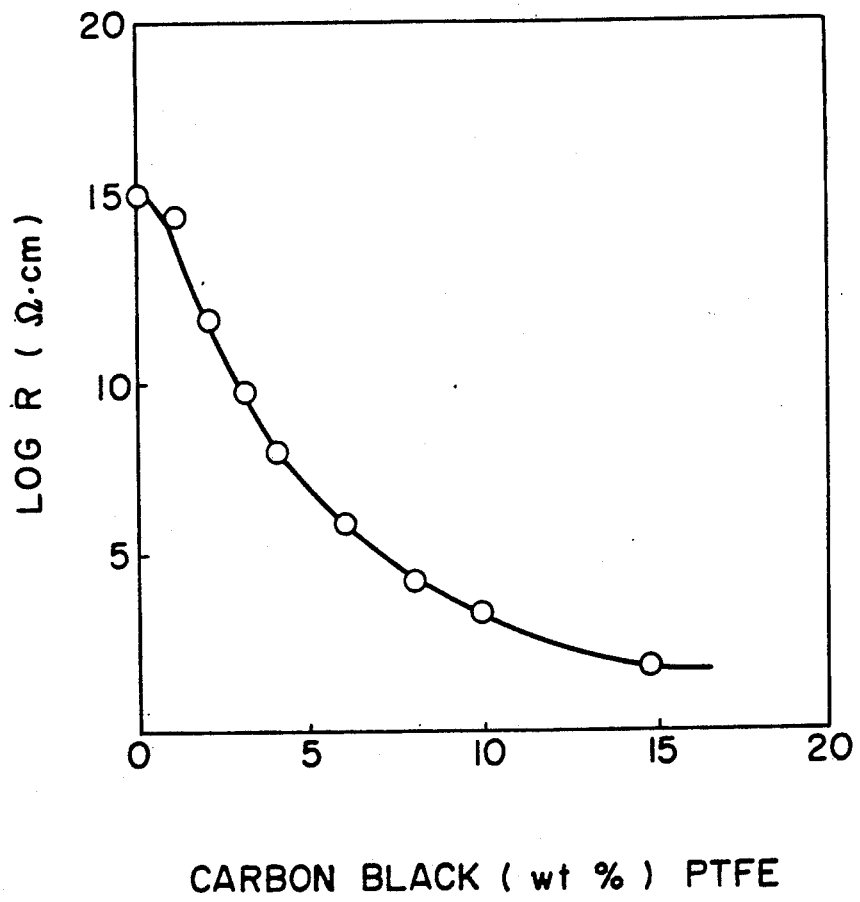
FIG. 2 is a graph exhibiting the relation between an amount of carbon black dispersed in PTFE resin, and a volume resistivity (Ωcm) of a heat roller

Weight % of the above-mentioned carbon black dispersively contained in a PTFE resin is shown in FIG. 2 in a relation with a volume resistivity $\Omega$cm.

The volume resistivity is measured with an electrometer (Programmable Electrometer 617 manufactured by Kesley) in such a manner that gold is vacuum-evaporated in a size of 1cm×1cm on a surface of a heat roller having a 20$\mu$m-thick resin layer.

The primers applicable to the releasable resins of the above-mentioned primer layer 12 include a liquid type primers principally comprising of a fluoro resin, which are available on the market as an adhesive priming agent applicable to the metal materials such as an iron alloy, an aluminum alloy and so forth. The typical examples thereof include Cookware (A-primer) 459-882 manufactured by DuPont. MP902BN manufactured by Mitsui Fluoro chemical Co., and so forth.

The heat roller of the invention is prepared in such a manner that the above-mentioned liquid type primer is coated on an aluminum cylindrical substrate, a dispersion solution of powder such as PFA or the like and carbon black is further coated thereon, and then the substrate is subjected to drying and if necessary, heat treatment.

The developer of the invention contain an inorganic fine particle. Such inorganic fine particle includes silica, alumina, titanium oxide, barium titanate, magnesium titanate. calcium titanate, strontium titanate, zinc oxide, quartz sand, clay, mica, wollastonite, diatom earth, chromium oxide, cerium oxide, iron oxide red, antimony trioxide, magnesium oxide, zirconium oxide, barium sulfate, barium carbonate, calcium carbonate, silicon carbide, silicon nitride, and so forth. Among them, fine particle silica is particularly preferable.

The fine particle silica has a Si—O—Si bond and is prepared by either of dry and wet processes. It is allowed to use any of aluminium silicate, sodium silicate, potassium silicate, magnesium silicate, zinc silicate, and so forth, as well as anhydrous silica dioxide. It is, however, preferable to use those containing $SiO_2$ of not less than 85wt%.

The inorganic fine particle applicable to the invention comprises pH of not lower than 7.0.

pH is measured in the following manner

One hundred milliliters of distilled water is added to 4g of inorganic fine particle and the mixture is stirred vigorously by a homomixer for 5 minutes Distilled water is boiled to remove $CO_2$ so as to have pH of at least 5.5. In any case, a pH value should not be raised by adding an alkaline solution.

When measuring a pH value, a stirring is stopped and then, pH is measured by a glass-electrode pH meter. The pH meter is in advance by a buffer solution.

The fine particle silica available on the market, which shows pH of not less than 7.0, are Aerosil R 812 and Aerosil RX 200 each manufactured by Japan Aerosil Co., and so forth.

Such an inorganic fine particle can be provided with surface treatment by an amine-modified silicone compound to make its pH value not less than 7.0, which meets practical use.

The above-mentioned amines include primary, secondary and tertiary amines, and further include ammonium salts derived from tertiary amine The preferable examples of the amine-modified silicone compounds include an amine-modified silane coupling agent, an amine-modified silicone oil, and a polysiloxane containing an ammonium salt (polysiloxane ammonium salt).

The publicly known techniques can be applied for treating the surfaces of inorganic fine particle with the above-mentioned amine-modified silicone compound To be more concrete, these techniques include a method in which inorganic fine particles are dispersed in a solution dissolving a silicone compound and the solvent is removed by a filtration or a spray dry method, followed by heating to dry and cure another method in which inorganic fine particles on a fluid bed are coated by spraying a solution dissolving the silicone compound and heated to remove the solvent and form coating thereon.

An average primary particle size of the inorganic fine particles is preferably 3mμ to 2μm and more preferably 5mμ to 500mμ. A specific area measured by nitrogen adsorption of a BET method is preferably 20 to 500 $m^2/g$. The inorganic particles having a too small average particle size, or a too large specific area are liable to remain on a drum after cleaing by a blade and cause poor cleaning. On the other hand, the inorganic particles having a too large average particle size or a too small specific area are liable to lower fluidity of a developer and make chargeability unstable, which is liable to result in lower durability of the developer.

The above-mentioned inorganic fine particles composing a developer are contained in the developer in such a state that the inorganic particles adhere to a surface of a toner particle, wherein a carriers and the like are also mixed therewith.

An addition ratio of inorganic fine particles is preferably 0.1to 5 wt%, and more preferably 0.1to 2 wt%. A too small addition of the inorganic particles is liable to lower fluidity of a developer and therefore deteriorate a triboelectrification of a toner, which is liable to result in causing fog due to difficulty of providing a toner with a prescribed positive charge. An excessive addition thereof is liable to isolate a part of the inorganic fine particles from the toner particles, so that the isolated inorganic particles adhere to the carrier particles, or adhere and accumulate on an inner wall of a developing unit, a developing sleeve, a regulating blade, and so forth, consequently which is liable to result in deteriorating a triboelectrification of a toner earlier and causing fog, lowering of an image density, and the like due to difficulty of providing the toner with a prescribed positive charge.

The inorganic fine particles having a pH value of not lower than 7.0 and provided with a surface treatment by an amine-modified silicone compound comprise an excellent moisture resistance and durability, and stable positive triboelectrification chargeability free of affection by environmental conditions.

The amine-modified silane coupling agents relating to the invention include the following compounds.

$H_2NCH_2CH_2CH_2CH_2Si(OCH_3)_3$ $H_2NCH_2CH_2CH_2Si(OC_2H_5)_3$ $H_2NCH_2CH_2\overset{\overset{CH_3}{|}}{C}H_2Si(OCH_3)_3$ $H_2NCH_2CH_2NHCH_2CH_2\overset{\overset{CH_3}{|}}{C}H_2Si(OCH_3)_2$ $H_2NCONHCH_2CH_2CH_2Si(OC_2H_5)_3$ $H_2NCH_2CH_2NHCH_2CH_2CH_2Si(OCH_3)_3$ $H_2NCH_2CH_2NHCH_2CH_2NHCH_2-CH_2CH_2Si(OCH_3)_3$ $H_5C_2OCOCH_2CH_2NHCH_2CH_2-Si(OCH_3)_3$ $H_5C_2OCOCH_2CH_2NHCH_2CH_2NH-CH_2CH_2CH_2Si(OCH_3)_3$ $H_5C_2OCOCH_2CH_2NHCH_2CH_2NH-CH_2CH_2NHCH_2CH_2NHCH_2-CH_2CH_2Si(OCH_3)_3$ $H_3COCOCH_2CH_2NHCH_2CH_2NH-CH_2CH_2CH_2Si(OCH_3)_3$ $(H_5C_2)_2NCH_2CH_2CH_2Si(OCH_3)_3$

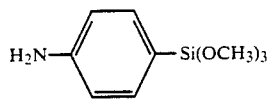

-continued

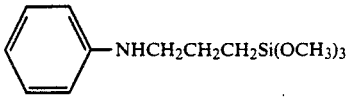

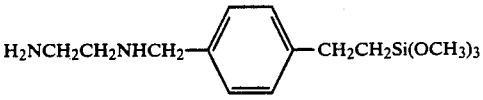

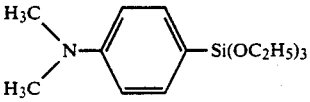

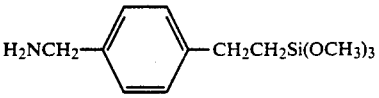

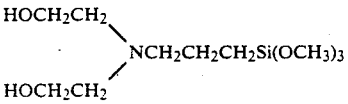

$(H_3CO)_3SiCH_2CH_2CH_2NHCH_2$ $(H_3CO)_3SiCH_2CH_2CH_2NHCH_2$ $(H_5C_2O)_3SiCH_2CH_2CH_2$
|
NH
|
$(H_5C_2O)_3SiCH_2CH_2CH_2$ $H_3CNHCH_2CH_2CH_2Si(OC_2H_5)_3$ $H_2N(CH_2CH_2NH)_2CH_2CH_2CH_2—Si(OCH_3)_3$ $H_3CNHCONH_2$
|
$C_3H_6Si(OCH_3)_3$

An alkoxy group of the above-given compounds may be substituted with a chlorine atom. The compounds may be used independently or in combination.

A preferable amine-modified silicone oil relating to the invention is represented by the following Formula 1:

Formula 1

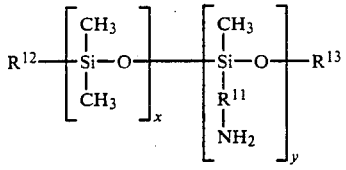

wherein $R^{11}$ represents an alkylene group, an arylene group, an aminoalkylene group or the like: $R^{12}$ and $R^{13}$ represent each a hydrogen atom, a hydroxyl group, an alkyl group, an aryl group, or the like: and x and y are each an integer of not less than 1.

An amine equivalent of the amine-modified silicone oil is preferably 200 to 22500, and more preferably 300 tO 10000. A too small amine equivalent is liable to result in less positive charging by the inorganic particles and an unclear image with fog. On the other hand, the too large amineequivalent is liable to promote adherence of the inorganic particles to the carrier particles and lower a durability of a developer.

A viscosity of the amine-modified silicone oil at 25° C. is preferably 10 to 10000 cps, and more preferably 20 to 3500 cps. A too low viscosity increase tackiness of the inorganic particles and is liable to lower a durability of a developer. On the other hand, too high viscosity makes it difficult to provide a proper surface-treatment and is liable to result in unstable positive chargeability of a toner and a lower durability of a developer.

The examples of the preferable amine-modified silicone oil available on the market are given in the following table.

| Brand | Viscosity at 25° C. (cps) | Amine equivalent |
|---|---|---|
| SF 8417, mfd. by Toray Silicone Company | 1200 | 3500 |
| KF 393, mfd. by Shin-Etsu Chemical Company | 60 | 360 |
| KF 857, mfd. by Shin-Etsu Chemical Company | 70 | 830 |

-continued

| Brand | Viscosity at 25° C. (cps) | Amine equivalent |
|---|---|---|
| KF 860, mfd. by Shin-Etsu Chemical Company | 250 | 7600 |
| KF 861, mfd. by Shin-Etsu Chemical Company | 3500 | 2000 |
| KF 862, mfd. by Shin-Etsu Chemical Company | 750 | 1900 |
| KF 864, mfd. by Shin-Etsu Chemical Company | 1700 | 3800 |
| KF 865, mfd. by Shin-Etsu Chemical Company | 90 | 4400 |
| KF 369, mfd. by Shin-Etsu Chemical Company | 20 | 320 |
| KF 383, mfd. by Shin-Etsu Chemical Company | 20 | 320 |
| X-22-3680, mfd. by Shin-Etsu Chemical Company | 20 | 8800 |
| X-22-380D, mfd. by Shin-Etsu Chemical Company | 2300 | 3800 |
| X-22-3801C, mfd. by Shin-Etsu Chemical Company | 3500 | 3800 |
| X-22-3810B, mfd. by Shin-Etsu Chemical Company | 1300 | 1700 |

In the invention, polysiloxane containing an ammonium salt is preferably has dimethylpolysiloxane containing an ammonium salt, which has high positive chargeability and scarecely causes poor cleaning. The above-mentioned dimethylpolysiloxane containing an ammonium salt includes, generally, dimethylsiloxane having the structural unit represented by the following Formula A, and is represented by the following Formula B.

Formula A

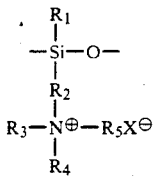

wherein $R_1$ represents a hydrogen atom, a hydroxy group, an alkyl group, an aryl group, or

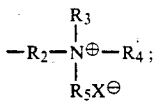

$R_2$ represents a linkage group such as, an alkylene group, an arylene group, an aralkylene group, —NH—, —NHCO—, a combination of these groups or the like or a simple linkage: $R_3$, $R_4$ and $R_5$ represent each a hydrogen atom, an alkyl group or an aryl group: X represents a halogen atom: and the groups represented by $R_1$ through $R_3$ include those having substituents.

Formula B

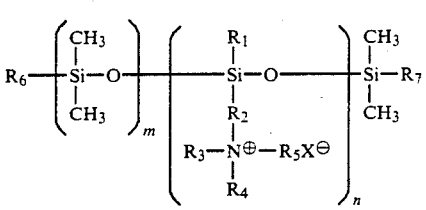

wherein $R_6$ and $R_7$ represent each a hydrogen atom, a hydroxy group, an alkyl group, an aryl group or an alkoxy group, and these groups include those having substituents: $R_1$ through $R_5$ and X are each synonymous with those denoted in and m and n are each an integer of not less than 1.

Further, to be more concrete,

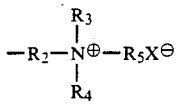

includes those having the following structures, however, the invention shall not be limited thereto.

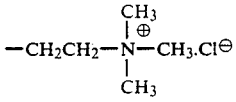

(1)

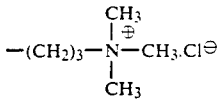

(2)

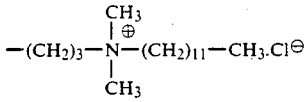

(3)

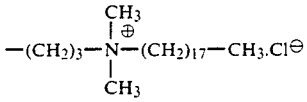

(4)

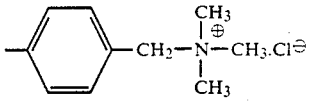

(5)

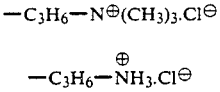

(6)

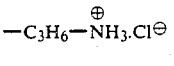

(7)

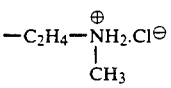

(8)

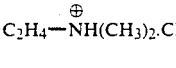

(9)

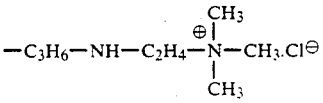

(10)

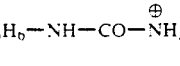

(11)

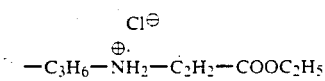

(12)

-continued (13)

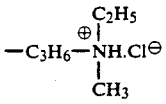

(14)

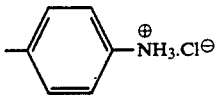

(15)

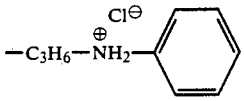

(16)

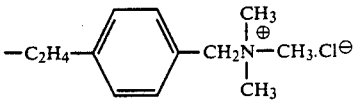

(17)

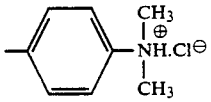

(18)

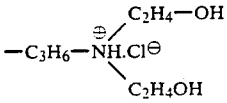

(19)

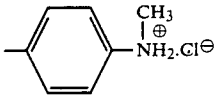

A polysiloxane ammonium salt can be prepared by a methOd where there are copolymerized halogenated organo silanes with and without an ammonium salt as a functional group: a method where polysiloxane prepared by polymerizing halogenated organo silane is partly modified by an organic group having an ammonium salt as a functional group: and the like. In these method, it is allowed to use organoalkoxysilane in place of halogenated organo silane. Some of the compounds are available on the market.

The electrostatic latent image developing toner relating to the invention comprises of a colorant and a binder usually applicable to a toner, such as a polyester resin, a styrene-acryl type resin or an epoxy resin. The resin may contain, if required, a magnetic material and a property improving agent.

The above-mentioned colorants applicable to the invention include, carbon black, nitrosine dye C.I. No. 504158, aniline blue C.I. No. 50405, charco oil blue C.I. No. Azoic Blue 3, chrome yellow C.I. No. 14090, ultramarine blue C.I. No. 77103, DuPont oil red C.I. No. 26105, quinoline yellow C.I. No. 47005, methylene blue chloride C.I. No. 52015, phthalocyanine blue C.I. NO. 74160, malachite green oxalate C.I. No. 42000, lamp black C.I. No. 77266, rose bengale C.I. No. 45435, and the mixtures thereof An addition of a colorant is usually 0.1 to 20 parts by weight per 100 parts by weight of a toner, and preferably 0.5 to 10 parts by weight.

The above-mentioned magnetic materials include, for example, ferromagnetic metals such as iron, cobalt, nickel and so forth, the alloys thereof and the compounds containing these elements, as well as ferrite and magnetite: alloys containing no ferromagnetic element but capable of having ferromagnetism by applying a suitable heat treatment, including Heuslar alloys containing manganese and copper, such as a manganese-copper-aluminium alloy, a manganese-copper-tin alloy, and so forth: chromium dioxide, and so forth. In the case of preparing a black toner, it is particularly preferable to use magnetite which can have a function of a colorant because of its black color. In the case of preparing a color toner, a less blackish material such as metal iron is preferably used Some of these magnetic materials have the functions of colorants, and may be used as a colorant. These magnetic materials are uniformly dispersed in a resin in a form of fine powder having an average partiCle Size Of 0.01 to 1$\mu$m. In the case of preparing magnetic toners, a content thereof is 20 to 150 parts by weight per 100 parts by weight of a toner resin, and more preferably 40 tO 100 parts by weight.

The above-mentioned property improving agents include a fixability improving agent, a charge controlling agent, and so forth.

The fixability improving agents include polyoleffin, an aliphatic acid metal salt, an aliphatic ester, an aliphatic ester type wax, a partly saponified aliphatic ester, a higher aliphatic acid, a higher alcohol, a liquid or solid paraffin wax, a polyamide type wax, a polyhydric alcohol ester, a silicone wax, an aliphatic fluorocarbon, and so forth. It is particularly preferable to use a wax having a softening point of 60 to 150° C. measured in a ring-and-ball method specified in the Japanese Industrial Standard, JIS K2531.

The charge controlling agents include well known ones, such as a nigrosine type dye, a metal-containing dye, and so forth.

One example of the preferable methods for preparing the toner of the invention is like this: first, a resin for a binder, or a resin containing the toner components such as a colorant and so forth is fused and kneaded with an extruder; it is then pulverized finely by a jet-mill after cooling, and classified to obtain a toner having a desired particle size: or a toner having a desired particle size can be obtained by spraying with a spray drier or dispersing in a solution a fused material after kneading with an extruder The toners of the invention are applied for developing an electrostatic latent image formed by an electrophotographic copy machine, and a toner image is electrostatically transferred on a transfer paper for fixing with a heat fixing roller to obtain a copy image

EXAMPLE

I. Developer

One example of the preferable electrostatic developers of the invention will be detailed below

Preparation of binder resin

Dicarboxylic acid and dialcohol shown in Table 1 were put into a one liter 4-neck round-bottom flask equipped with a thermometer, a stainless-steel stirrer, a glass tube for introducing nitrogen gas and a reflux condenser The flask was placed on a mantle heater, and heated keeping an inside of the flask inert by introducing nitrogen gas from the glass tube. Next, 0.05g of tin dibutyloxide was added to accelerate a reaction while keeping a temperature at 200° C., and a trivalent monomer shown in Table 1 was added for further reaction.

TABLE I

| Acid component | | Alcohol component | |
|---|---|---|---|
| 1,2,4-benzene tricarboxylic acid anhydride | Terephthalic acid | Bisphenol A. propylene oxide | Bisphenol A. ethylene oxide |
| 248 g (60 mol %) | 143 g (40 mol %) | 350 g (70 mol %) | 271 g (30 mol %) |

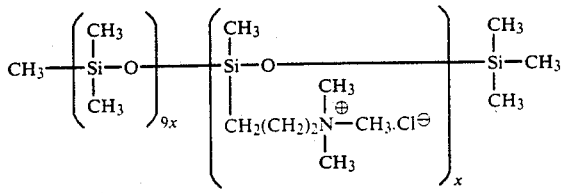

(x is an integer)

| Preparation of toner | Parts by weight |
|---|---|
| The above-given binder resin | 100 |
| Carbon black, Mogal L manufactured by Cabot Co. | 100 |
| Low molecular weight polypropylene. Viscol 660P manufactured by Sanyo Chemical Co. | 2 |
| Alkylene bis aliphatic acid amide, Hoechst Wax C manufactured by Hoechst AG. | 2 |

The above-given materials were mixed, and fused for kneading by an extruder. After cooling, it was roughly pulverized, and then finely pulverized by a super-sonic jet-mill. The pulverized matter was classified by a pneumatic classifier to obtain a toner powder having an average particle size of 11.0μm.

Preparation of inorganic fine particles (1) Inorganic fine particle 1 (invention):

fine particle silica. Aerosil RA200H (manufactured by Japan Aerosil Co.) treated with an amine-modified silane coupling agent and hexamethyl disilazane (2) Inorganic fine particle 2 (invention):

100 parts by weight of fine particle silica. Aerosil 200 (manufactured by Japan Aerosil Co.) having an average particle size of 12mμ and a BET specific surface area of 200 $m^2/g$ was put into a high speed rotary mixer.

and then a processing solution prepared by dissolving 10 parts by weight of an amine-modified silicone oil SF 8417 (manufactured by Toray Silicone Co.) having an amine equivalent of 3500 and a viscosity of 1200 cps at 25° C. and 8 parts by weight of hexamethyldisilazane SZ 6079 (manufactured by Toray Silicone Co., i.e.) in 100 parts by weight of hexane was added dropwise into the hi9h speed rotary mixer to provide a surface treatment: the content of the mixer was transferred to a flask and was heated at a temperature of 100° C. to 150° C. with stirring in an inert gas atmosphere for 5 hours to remove the solvent, hexane and promote the reaction: for preparing the inorganic fine particle 2 having an average particle size and a BET specific surface area of 13mμ and 180 $m^2/g$, respectively.

(3) Inorganic fine particles 3 (invention):

a processing solution prepared by dissolving the following polysiloxane ammonium salt in xylene was sprayed on a fine particle silica. Aerosil 200 (manufactured by Japan Aerosil Co.) put into a mixer so that a content of polysiloxane was 5 wt% to the fine particle silica: then, the resulted matter was put into a flask and heated at 200° C. with stirring for 5 hours to obtain a surface-treated inorganic fine particle 3 having an average primary particle size of 12mμ and a BET specific surface area of 115 $m^2/g$.

(4) Inorganic fine particle 4 (invention):

fine particle silica. Aerosil RX200 (manufactured by Japan Aerosil Co.) treated by hexamethyldisilazane (5) Inorganic fine particle 5 (invention)

fine particle alumina Aerosil RX-C (manufactured by Japan Aerosil Co.) treated with hexamethyldisilazane (6) Inorganic fine particle (1) (comparison):

negatively chargeable fine particle silica. Aerosil R-972 (manufactured by Japan Aerosil Co.).

the pH values of the respective inorganic fine particles are shown in Table 2.

TABLE 2

| Inorganic fine particle | Processing agent | Fine particle subject to processing | Material on the market | pH*1 |
|---|---|---|---|---|
| Invention 1 | Amine-modified silane coupling agent + HMDS*2 | Aerosil 200 | Aerosil RA200H | 9.3 |
| Invention 2 | Amine-modified silicone oil + HMDS | Aerosil 200 | | 8.7 |
| Invention 3 | Polysiloxane $NH^4$ salt | Aerosil 200 | | 9.0 |
| Invention 4 | HMDS | Aerosil 200 | Aerosil RX200 | 8.2 |
| Invention 5 | HMDS | Aerosil aluminium oxide C | Aerosil RX-C | 7.8 |
| Comparison 1 | — | — | Aerosil R-972 | 3.8 |

*1A value obtained when a subject material is dispersed in a proportion of 4% into a solution of methanol and eater (1:1)

*2Hexamethyldisilazane

Preparation of carrier

A coating solution was prepared by dissolving 6g of a vinylidene fluoride-ethylene tetrafluoride copolymer, VT-100 (manufactured by Daikin Industrial Co.) having a copolymerization mole ratio of 80:20 and an intrinsic viscosity of 0.95 dl/g, and 6g of a methyl methacrylate copolymer. Acrypet MF (manufactured by Mitsubishi Rayon Co.) in 500 ml of a mixed solvent of acetone and methylethyl ketone (a volumetric mixing ratio of 1:1). The coating solution was coated by making use of a fluid bed over 1kg of magnetic grains comprising globular copper-zinc type ferrite manufactured by Japan Iron Powder Industries Co. The coated magnetic grains were heated at 200° C. for 5 hours, and then classified to obtain a carrier having a resin coating layer of about 2μm. The average grain size of the carrier was 82μm.

Preparation of developer

A developer was prepared by mixing with a V type mixer 5 parts by weight of a complex toner prepared by mixing with a Henschel mixer 0.8 parts by weight of the above-mentioned inorganic fine particles and 100 parts by weight of the toner prepared in the above-mentioned process, and 100 parts by weight of the carrier.

II. Heat roller

Table 3 shows the specifications of the fixing rollers A through H of the invention and the fixing roller I of the comparison.

Carbon black was added in the aforementioned manner.

TABLE 3

| Heat roller | Composition and characteristics | Composition of releasing layer (%) PTA | Carbon black | Volume resistivity of heat roller (Ω cm) |
|---|---|---|---|---|
| A (invention) | | 99 | 1 | $5 \times 10^{14}$ |
| B (invention) | | 98 | 2 | $5 \times 10^{11}$ |
| C (invention) | | 97 | 3 | $5 \times 10^{9}$ |
| D (invention) | | 96 | 4 | $1 \times 10^{8}$ |
| E (invention) | | ·94 | 6 | $1 \times 10^{6}$ |
| F (invention) | | 92 | 8 | $2 \times 10^{4}$ |
| G (invention) | | 90 | 10 | $2 \times 10^{3}$ |
| H (invention) | | 85 | 15 | 50 |
| I (Comparison) | | 100 | 0 | $2 \times 10^{15}$ |

III. Evaluation of anti-offset property

Table 4 shows the temperature at which the offset phenomena take place in the combinations of the heat rollers and the developers containing inorganic fine particles prepared by the above-mentioned method.

The evaluation tests were performed with a modified KONICA u-1550 copying machine (a line speed of 139 mm/sec.) after repeating a copying operation enough times to stabilize the temperatures of a heat roller and a back up roller.

TABLE 4

| Heat roller | Inorganic fine particle | Invention 1 | 2 | 3 | 4 | 5 | Comparison 6 |
|---|---|---|---|---|---|---|---|
| A (Invention) | | ○ | ○ | ○ | ○ | ○ | ○ |
| B (Invention) | | ○ | ○ | ○ | ○ | ○ | ○ |
| C (Invention) | | ◎ | ◎ | ◎ | ◎ | ◎ | ◎ |
| D (Invention) | | ◎ | ◎ | ◎ | ◎ | ◎ | ◎ |
| E (Invention) | | ◎ | ◎ | ◎ | ◎ | ◎ | ◎ |
| F (Invention) | | ◎ | ◎ | ◎ | ◎ | ◎ | ◎ |
| G (Invention) | | ○ | ○ | ○ | ○ | ○ | ○ |
| H (Invention) | | ○ | ○ | ○ | ○ | ○ | ○ |

TABLE 4-continued

| Heat roller | Inorganic fine particle | Invention 1 | 2 | 3 | 4 | 5 | Comparison 6 |
|---|---|---|---|---|---|---|---|
| I (Comparison) | | X | X | X | X | X | Δ |

X: Offset at 210° C.,
○: No offset at 230° C.,
Δ: Offset at 220° C.
◎: No offset even at 240° C.

In the combinations of the heat rollers of the invention and the developers containing any of the inorganic fine particles of the invention, no offsets were produced even at 230° C. Especially, no offsets were found even at 240° C. when the heat roller C, D, E and F of the invention were used.

On the other hand, in the combinations of the heat roller of the comparison and the developers containing the inorganic fine particles of the invention, the offsets were found at 210° C., which does not meet a practical application level.

Further, in the combination of the heat roller of the comparison and the developer containing the inorganic fine particles of the comparison, an offset was produced at 220° C., and even at 210° C. in some cases.

IV. Overall evaluation

Table 5 shows the overall performance evaluation results of the practical copying operation carried out with a modified KONICA u-1550 copying machine (a line-speed of 139 mm/sec.) at a fixing temperature of 200° C., under the conditions of a high temperature of 33° C. and a high humidity of 80%RH.

In any of the combinations of the heat rollers of the invention and the developers containing the inorganic fine particles of the invention (Examples 1 through 8). the copy images were excellent even after 60,000 cycles.

Especially, as the developers containing the inorganic fine particles 1, 2 and 3 of the invention exhibited very stable charging on a toner, the copying operations of Examples 2 through 5 were further continued and the copy images were found excellent up to 100,000 cycles.

On the other hand, in either combinations of the developers containing the inorganic fine particles of the comparison and any heat rollers, the edges of the copy images were stained by a scattering toner up to 15,000 cycles.

TABLE 5

| | Heat roller | Inorganic fine particle | Practicle imaging characteristics | Judgement |
|---|---|---|---|---|
| Example | | | | |
| 1 | Inv. B | Inv. 4 | Excellent, up to 60,000 cycles | ○ |
| 2 | Inv. C | Inv. 3 | Excellent, up to 100,000 cycles | ◎ |
| 3 | Inv. F | Inv. 1 | Excellent, up to 100,000 cycles | ◎ |
| 4 | Inv. F | Inv. 2 | Excellent, up to 100,000 cycles | ◎ |
| 5 | Inv. F | Inv. 3 | Excellent, up to 100,000 cycles | ○ |
| 6 | Inv. F | Inv. 4 | Excellent, up to 60,000 cycles | ○ |
| 7 | Inv. F | Inv. 5 | Excellent, up to 60,000 cycles | ○ |
| 8 | Inv. G | Inv. 4 | Excellent, up to 60,000 cycles | ○ |
| Comp. Ex. | | | | |

TABLE 5-continued

| | Heat roller | Inorganic fine particle | Practicle imaging characteristics | Judgement |
|---|---|---|---|---|
| 9 | Inv. B | Comp. 6 | Image stain up to 15,000 cycles | X |
| 10 | Inv. D | Comp. 6 | Image stain up to 15,000 cycles | X |
| 11 | Inv. F | Comp. 6 | Image stain up to 15,000 cycles | X |
| 12 | Inv. H | Comp. 6 | Image stain up to 15,000 cycles | X |
| 13 | Comp. I | Comp. 6 | Image stain up to 15,000 cycles | X |

What is claimed is:

1. A method for forming an electrophotographic image, comprising forming an electrostatic latent image on a latent image carrier, developing said latent image with a developer to form a toner image, transferring said toner image onto a recording material, and fixing the toner image with a heat roller, wherein said method is characterized by:

1) said developer comprises a toner containing carbon black and inorganic fine particles having a pH of at least 7.0, wherein said pH is measured by
   a) adding 4 grams of said fine particles to 100 ml of distilled water to form a mixture, and stirring said mixture vigorously,
   b) stopping the stirring and measuring the pH of said mixture with a pH meter,
2) said heat roller having an outer layer containing carbon black and being grounded.

2. The method of claim 1, wherein a volume resistivity of said resin coating layer is $10^4$ to $10^{11}$ Ωcm.

3. The method of claim 2, wherein a resin for the resin coating layer is a fluorinated resin.

4. The method of claim 1, wherein a bearing of said heat roller is made of a conductive material.

5. The method of claim 1, wherein a surface of said inorganic fine particle is treated with a silicone compound.

6. The method of claim 5, wherein said silicone compound is an amine-modified silicone compound.

7. The method of claim 6, wherein said amine-modified silicone compound is an amine-modified silane coupling agent, an amine-modified silicone oil or a polysiloxane containing an ammonium salt.

8. The method of claim 5, wherein an average primary particle size of said inorganic fine particle is 3 mμ to 2 μ m.

9. The method of claim 8, wherein said average primary particle size is 5 mμ to 500 mμ.

10. The method of claim 5, wherein a BET specific surface area of said inorganic fine particle is 20 to 500 $m^2/g$.

11. The method of claim 10, wherein a content of said inorganic fine particle is 0.1 to 5 % by weight to a toner.

12. The method of claim 11, wherein said content is 0.1 to 2 % by weight.

* * * * *